US005130749A

United States Patent [19]

Tanada

[11] Patent Number: 5,130,749

[45] **Date of Patent: * Jul. 14, 1992**

[54] ELECTROPHOTOGRAPHIC COPYING MACHINE AND METHOD FOR PRE-COPY OPERATION

[76] Inventor: Toyoki Tanada, 810-34 Tsutsui-cho, Yamatokoriyama-shi, Nara-ken, Japan

[ * ] Notice: The portion of the term of this patent subsequent to Sep. 10, 2002 has been disclaimed.

[21] Appl. No.: 93,154

[22] Filed: Sep. 2, 1987

Related U.S. Application Data

[63] Continuation of Ser. No. 622,465, Jun. 20, 1984, abandoned.

[30] Foreign Application Priority Data

Jun. 24, 1983 [JP] Japan ..... 58-114890
Jun. 24, 1983 [JP] Japan ..... 58-114891

[51] Int. Cl.[5] ..... G03G 21/00
[52] U.S. Cl. ..... 355/208
[58] Field of Search ..... 355/3 R, 14 C, 203, 355/204, 208, 210

[56] References Cited

U.S. PATENT DOCUMENTS 3,586,450 6/1971 Hosey et al. ..... 355/14 R X
3,669,535 6/1972 Hyosaka et al. ..... 355/14 R X
3,976,375 8/1976 Kurita et al. ..... 355/14 R
4,017,170 4/1977 Komori et al. ..... 355/14 R X
4,133,477 1/1979 Marino et al. ..... 364/900 X
4,139,300 2/1979 Katayama et al. ..... 355/14 R
4,343,036 8/1982 Shimizu et al. ..... 355/14 C X
4,465,360 8/1984 Yamagishi et al. ..... 355/14 R
4,474,455 10/1984 Hirakura et al. ..... 355/14 R
4,540,270 9/1985 Imanaka et al. ..... 355/14 C X

OTHER PUBLICATIONS

Underhill, T. T., "Erase Lamp Control", IBM Technical Disclosure Bulletin, vol. 19, No. 2, Jul. 1976, pp. 393 and 394.

*Primary Examiner*—Fred L. Braun

[57] ABSTRACT

An electrophotographic copying machine is of the type which starts, in response to the actuation of a copy start switch, its copying operation after a pre-copy process is conducted to stabilize the property of a photoreceptor. The copying machine includes a timer. The timer is started automatically upon the termination of a previous copying operation. During a time as set for the timer, the pre-copy process is carried out following the termination of the previous copying operation. In response to the actuation of the copy start switch, the following copying operation is started just following the termination of the previous copying operation. In a preferred form of the present invention, a ready lamp is provided for indicating that the copying operation is now possible, the ready lamp being switched on in response to the completion of the previous copying operation. In another preferred form of the present invention, the position of a photoreceptor is detected.

32 Claims, 5 Drawing Sheets

ELECTROPHOTOGRAPHIC COPYING MACHINE AND METHOD FOR PRE-COPY OPERATION

This application is a continuation of application Ser. No. 622,465 filed on Jun. 20, 1984, now abandoned.

BACKGROUND OF THE INVENTION

The present invention relates to an electrophotographic copying machine and, more particularly, to a circuit for quickly initializing and stabilizing the property of a photoreceptor in an electrophotographic copying machine.

An electrophotographic copying machine produces an electrostatic latent image onto a photoreceptor corresponding to a pattern image on a document such as a manuscript or book to be copied. Toner particles are electrostatically adhered to the latent image, so that the latent image becomes visible as a toner image. The toner image on the photoreceptor is transferred onto a copy paper via a transference charger.

Conventionally, around the photoreceptor, various means are provided for causing the various processes including charging, light exposure, developing, transferring, charge removing and cleaning. In addition, a copy paper feeding means is provided for feeding the copy paper into the transferring means and there is a fixing device.

After a full operation of copying the first document, all the various means are stopped in view of the life times of the photoreceptor and the mechanical elements, so that they are placed in the copy ready. In response to the next copy instruction, all the means are started to be activated to copy the second document.

To stabilize the property of the photoreceptor, before starting a new copy operation, the receptor is fully revolved without any copying operation in a condition identical with the copying operation condition while all the means are activated. At this time, no copy paper is fed and transferred. This is called a "pre-copy process or operation" herein. The first copy operation is carried out after the pre-copy process. This results in prolonging the copying time because the time for the pre-copy process is added to the net copy operation time. When a plurality of documents are intended to be copied, such pre-copy processes are repeated each time a new document replaces the old one. This prolongs the copying time.

SUMMARY OF THE INVENTION

Accordingly, it is an object of the present invention to provide an improved electrophotographic copying machine for initializing and stabilizing the property of the copying machine when a new document to be copied replaces an old one.

It is another object of the present invention to provide an improved electrophotographic copying machine for shortening any loss time of initializing means for copying a new document just following the first document which has been copied.

It is a further object of the present invention to provide an improved electrophotographic copying machine for eliminating any loss time of conducting a pre-copy process for each of the second or more documents following the first document to be copied when a plurality of documents are intended to be copied.

It is a further object of the present invention to provide an improved electrophotographic copying machine comprising a timer circuit for conducting a pre-copy operation, the timer circuit being started in response to the end of a first copying operation, in which, during a time counted by the timer circuit, the precopy operation is to be carried out.

Briefly described, in accordance with the present invention, an electrophotographic copying machine is of the type which carries out a pre-copy process in response to the actuation of a copy start switch to stabilize the property of a photoreceptor before the copying operation is started. The copying machine comprises a timer means. The timer means is operated automatically upon the termination of a previous copying operation regarding the first document to be copied for counting a time during which the pre-copy process for the second document to be copied is started following the termination of the previous copying operation. Responsive to the actuation of the copy start switch, the copying operation is promptly started without needing any loss time of conducting the pre-copy process for the following copying operation. A copy ready indication means is provided which is switched on in response to the initial condition of a copy enabling means, in particular, the initial return of a document light scanning means or a switching off of a copy lamp for scanning the document.

In another form of the present invention, the copying machine comprises a detection means for detecting a central portion and a starting edge of a photoreceptor relating to a possible maximum copy document, a determination means for determining whether the size of a copy is less than half of the maximum size of the possible copy document, and a control means responsive to the detection of the detection means that the copy size is less than half of the maximum size for forming a latent image following the center portion or the starting edge of the photoreceptor.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
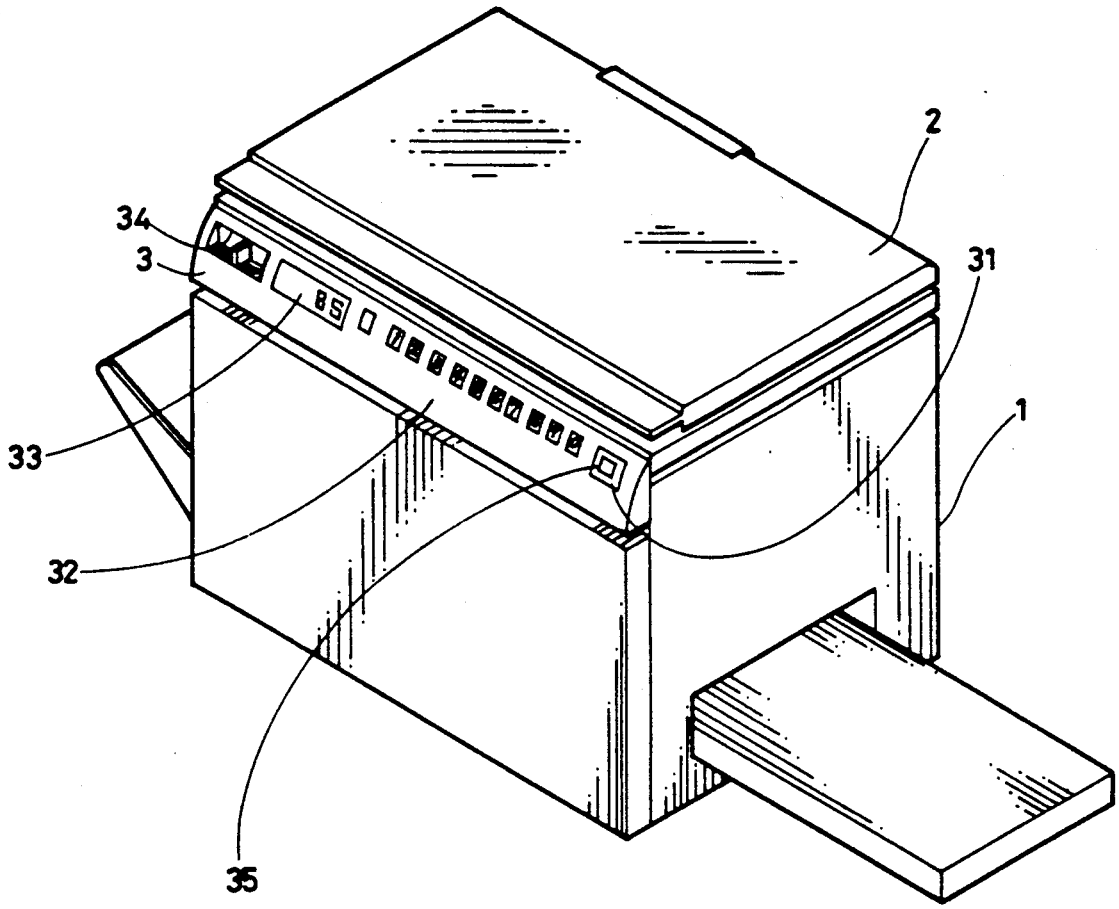
FIG. 1 is a perspective view of an electrophotographic copying machine according to the present invention.

Throughout the drawings, like elements are indicated by like reference numerals.

FIG. 1 shows a perspective view of an electrophotographic copying machine according to the present invention.

Referring to FIG. 1, the body of the copying machine includes a document cover 2 and an operation panel 3. The panel 3 includes a copy switch 31, numeral keys 32 of "0" to "9", a display 33, a copy density switch 34, and a copy ready lamp 35. The ready lamp 35 is switched on indicating that a copy is possible.

While the ready lamp 35 is switched on, the copy switch 31 is operated to start a copy operation. The numeral keys 32 are operated to select the number of copy papers to be copied. The display 33 is switched on to display the number of the copying papers and/or the copied papers. The copy density switch 34 is operated to control the copy image density.

Figure 2:
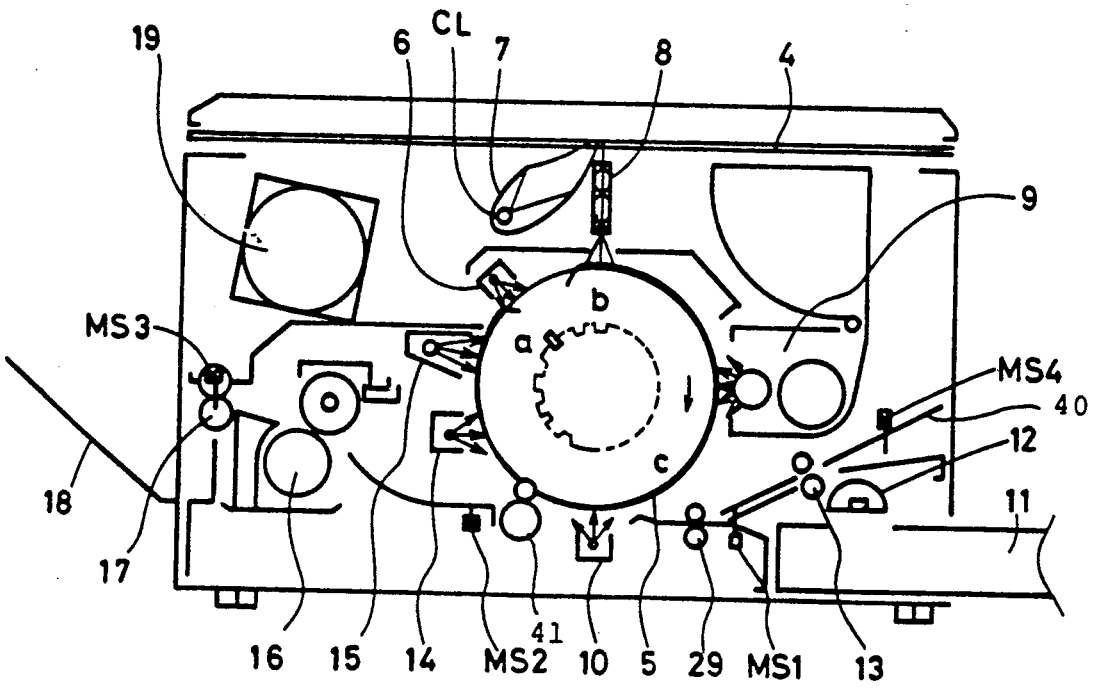
FIG. 2 shows a sectional side view of elements that may be provided within the copying machine according to the present invention.

FIG. 2 shows a side view revealing the contents of the copying machine of FIG. 1.

Referring to FIG. 2, a photoreceptor 5 is disposed around a rotational drum. A charger 6 is provided for charging the photoreceptor 5. A light exposing device 7 with a copy lamp CL is provided for exposing light toward the document and is mounted onto a document table 4 as the document table 4 is reciprocated in accordance with the rotation of the drum and the photoreceptor 5, so that the reflected light beams are incident onto the photoreceptor 5 through a lens array 8 to form a latent image. A developing and cleaning device 9 is provided for developing the latent image with toner particles to form a toner image and, after the copy operation is carried out with rotating the drum, for cleaning the photoreceptor 5 by removing the remaining toner particles from the photoreceptor 5. A transference charger 10 is provided for transferring the toner image onto a copy paper picked up from a number of copy papers as stored within a cassette 11. Some paper pick-up rollers 12 are provided for picking up a single copy paper from the papers in the cassette 11. Some paper feeding rollers 13 are provided for feeding the picked-up copy paper into the transference charger 10. A charge removing charger 14 is provided for charging the photoreceptor 5 in a polarity opposed to the polarity of the remaining charges on the photoreceptor 5 to remove the charges from the photoreceptor 5. A lighting device 15 is provided for lighting the photoreceptor 5 to remove the charges from the photoreceptor 5. A pair of fixing rollers 16 are provided for pressing the toner image onto the copy paper to fix the toner image thereon. A pair of exhaust rollers 17 are provided for expelling the copied paper from the body 1 of the copying machine to place the copied paper onto an expel tray 18.

It is to be noted that the application of the present invention should not be limited to the copying machine of this type as shown in FIG. 2.

Figure 3:
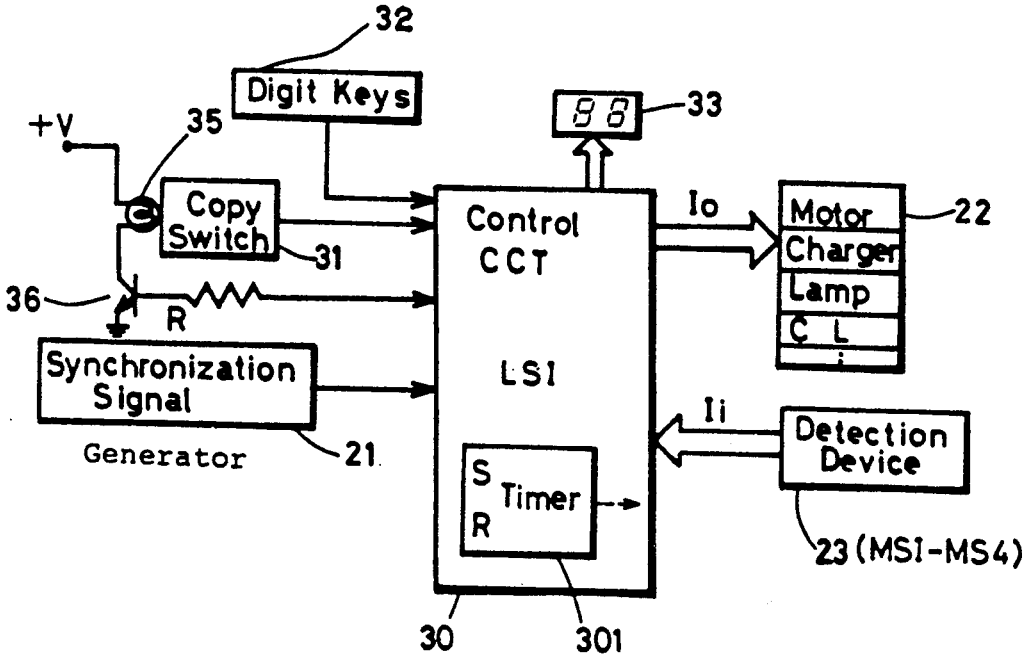
FIG. 3 is a block diagram of a circuit of the copying machine according to a first preferred embodiment of the present invention.

FIG. 3 shows a block diagram of a circuit implemented within the copying machine according to a first preferred embodiment of the present invention.

Referring to FIG. 3, in response to the actuation of the copy switch 31 during the illumination of the ready lamp 35, a control central processing unit (CPU) 30 provides a motor activating signal IO to activate a motor 19 so that the photoreceptor 5 is revolved via a transmission means not shown. A synchronization signal generator 21 is responsive to the rotation of the photoreceptor 5 for providing a synchronization signal representative of the rotational position of the photoreceptor 5. The synchronization signal is inputted into the control CPU 30, so that the control CPU 30 provides the control signal IO into a controlled means 22 for activating all the various elements including the motor 19, the charger 6, the charge removing lighting device 15 and the like which are disposed around the photoreceptor 5 to thereby enable a sequential copying operation including a copy paper feeding. Some detection means 23 (MS1–MS4) are provided responsive to the detections of the various elements for generating a detection signal Ii into the control CPU 30, so that the control CPU 30 controls the operations of the various elements.

According to the present invention, responsive to the generation of a copy end signal representative of the end of copying operation, the control CPU 30 causes a timer 301 to be started so that, during the time as set in the timer 301, the precopy process is continued to be carried out automatically after the termination of the previous copying operation. When the temperature of the fixing rollers 16 rises to a toner fixable temperature, a signal representative of this condition is inputted into the control circuit 30, so that the circuit 30 provides a signal switching the ready lamp 35 on if the other elements are placed at the initial conditions. This signal is applied to the base of a switching transistor 36 via a resistance R to turn the transistor 36 on. A current can flow into the ready lamp 35 to switch it on.

Figure 4:
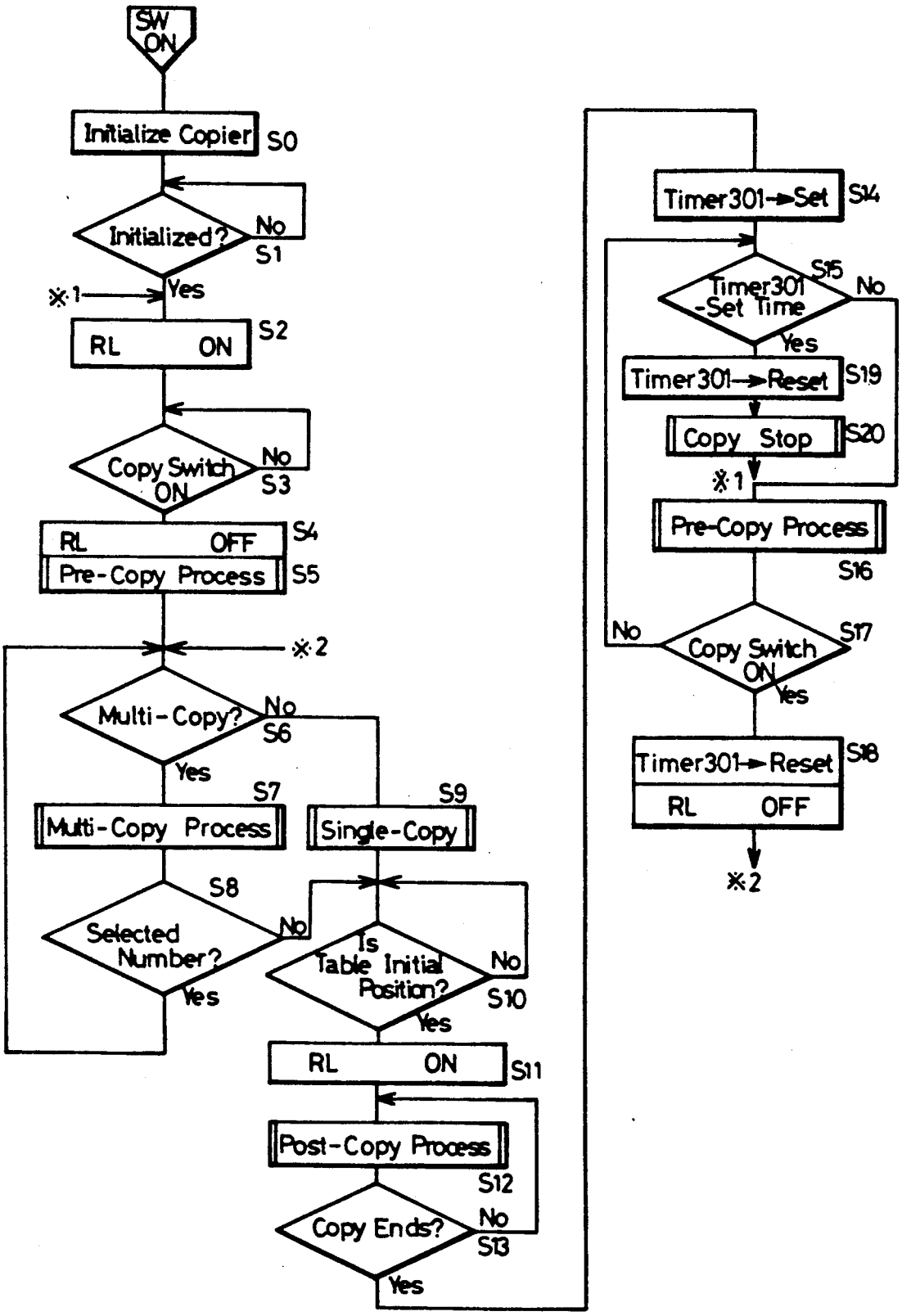
FIG. 4 is a flow chart of the operation of the copying machine according to the first preferred embodiment of the present invention.

FIG. 4 is a flow chart of the operation of the copying machine according to the first preferred embodiment of the present invention, in which the following steps are conducted:

S0: After the copying machine is switched on, the control CPU 30 is initialized.

S1: It is detected whether the copying machine is placed in its operable condition referenced as "Ready".

S2: When it is detected that the copying machine is placed in an operable condition, the control circuit 30 provides a signal switching the transistor 36 on. The ready lamp (RL) 35 is switched on.

S3: The actuation of the copy switch 31 is awaited after the illumination of the copy switch RL.

S4-S5: These steps are selected to switch the ready lamp 35 off after the copy switch 31 is operated. The pre-copy operation is now conducted.

S6: This step is selected to detect whether a multi-copy operation is selected in which a plurality of copied papers are to be prepared.

S7-S8-S6-S7: When the multi-copy operation is selected, these steps are repeated to plurally copy.

S9: This step is selected when a single copy operation is selected.

S10: This step is selected after the termination of the copying operation selected. This step is executed to detect whether the document table 4 is returned to its initial position. If not, a document return clutch (TRC') not shown is activated to return it. Even if the multi-copy operation is selected, S8-S10 are selected to await the return of the document table 4 after the termination of the multi-copy operation.

S11: This step is selected when the document table 4 is returned to the initial position. The ready lamp 35 is switched on indicating that a following copy operation is now possible.

S12-S13: The post-copy operation is conducted and it is detected whether the copy operation has been completed. This operation is necessary to place the copying machine in its initial condition. In this embodiment, after the document table 4 is returned to its initial position, the ready lamp 35 is switched on, before the post-copy operation has been started, informing the operator of the following necessary operation that the present document is to be replaced by a new one. This assists in shortening the copying time.

S14: The control circuit 30 causes the timer 301 to be set to start the counting of the time.

S15-S16: These steps are selected to enable the pre-copy operation without stopping the copying operation after the end of the copying operation.

S17: It is detected whether the copy switch 31 is operated. Steps S15-S16-S17-S15 are repeated. The "pre-copy process or opeation" as used herein indicates that the photoreceptor 5 is revolved, all the various elements positioned around the photoreceptor 5 are activated except feeding any copy paper. If necessary, it may be possible that the transference charger 9 is prevented from being operated. The control signal Io from the control CPU 30 enables the pre-copy process.

While the pre-copy process is continued to be carried out, a new document is placed onto the document table 4 to replace the old one. During the time as set in the timer 301, the copy switch 31 is operated so that step S17 is advanced to step S18 to reset the timer 301. Simultaneously, the ready lamp 35 is switched off. After the timer 301 is reset, S6 is selected in which it is detected whether the multi-copy operation is selected or not. Thereafter, the copy operation is started.

As described above, when a plurality of documents are intended to be copied, regarding the second or more documents, the pre-copy processes in step S5 are not carried out in response to the operation of the copy switch 31, but, the pre-copy processes in step S5 are automatically carried out in response to the termination of copying the first document. This shortens the copying times of copying the second or more documents as short as possible, in which the time of conducting the first copying operation regarding the second or more documents is substantially identical to the time of conducting each of the second or more copying operations regarding the second or more documents. Since, of course, the pre-copy process for the first copying operation regarding the first document cannot automatically be carried out, no loss time of conducting the pre-copy process for the first copying operation regarding the first document can be shortened.

Here, after the timer 301 is set, if the copy switch 31 is not operated after the time set for the timer 301, step S15 is advanced to step S20 in which the copying machine is stopped. Before step S20 is selected, step S19 is selected to reset the timer 301. After the copying machine is stopped, the copying machine is awaiting the operation of the copy switch 31 in step S3.

Preferably, the time to be set in the timer 301 is selected to be a time sufficient for the time in which the operator can dispose the document onto the document table 4 with even a usual motion. It may be possible that the timer 301 is separated from the control CPU 30 in which the control CPU 30 generates a set and reset signals into the separated timer. In such a case, after the time as set for the separated timer, a signal representative of this condition is entered into the control CPU 30, so that the control CPU 30 enables all the various elements to be stopped.

As described above, in accordance with the present invention, each of a plurality of copied papers is formed, in response to the actuation of the copy switch 31, via steps S6-S9-S10-S11-S12-S13-S14-S15, the pre-copy operation in step S16 is executed. By repeating steps S17-S15-S16-S17, the actuation of the copy switch 31 is awaited during the time counted by the timer 301. After the next document is placed on the document table 4, the copy switch 31 is operated to repeat the above steps. Thus, the time for the second copy or more can be shortened as mentioned above.

The ready lamp 35 is switched on after the document table 4 is returned to the initial position. The operator is informed that the document should be replaced by the next one before the start of the pre-copy operation in step S16. This can shorten the time of awaiting the operating of the copy switch 31 in step S17.

It may be possible that the optical system, in particular, the light emitting device is moved in connection with the document table while the document table 4 is made still. In such a case, in accordance with the completion of the document scanning by the light emitting device 7, the ready lamp 35 is switched on by detecting that the copy lamp CL is switched off. That is, in step S10, after it is detected that the copy lamp CL is switched off, the ready lamp RL is switched on.

An attention is now directed to a second preferred embodiment of the present invention.

Figure 5:
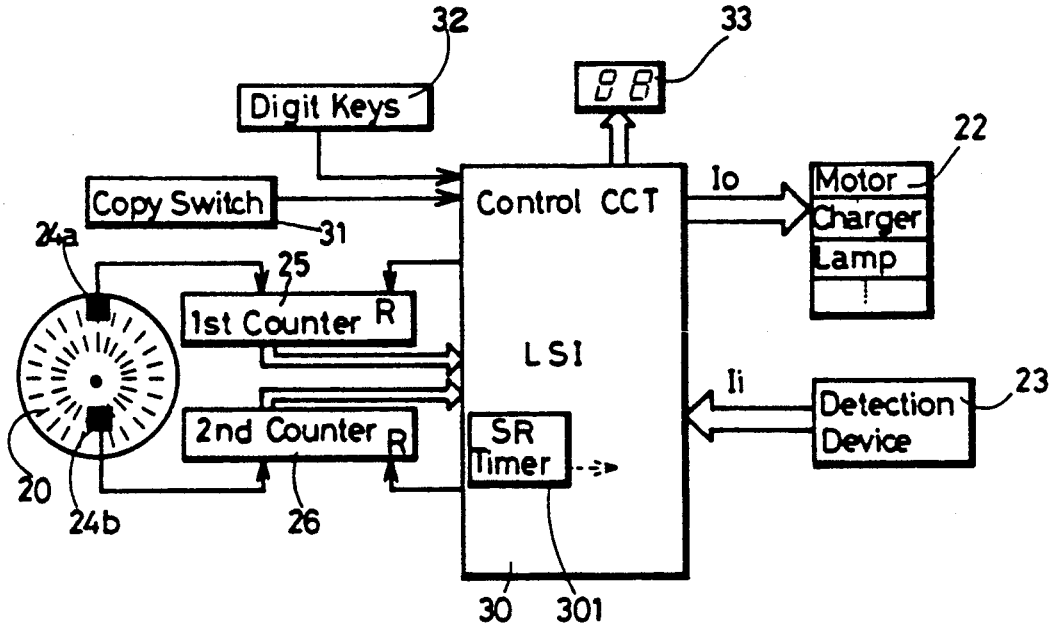
FIG. 5 is a block diagram of another circuit for the copying machine according to a second preferred embodiment of the present invention.
Figure 6:
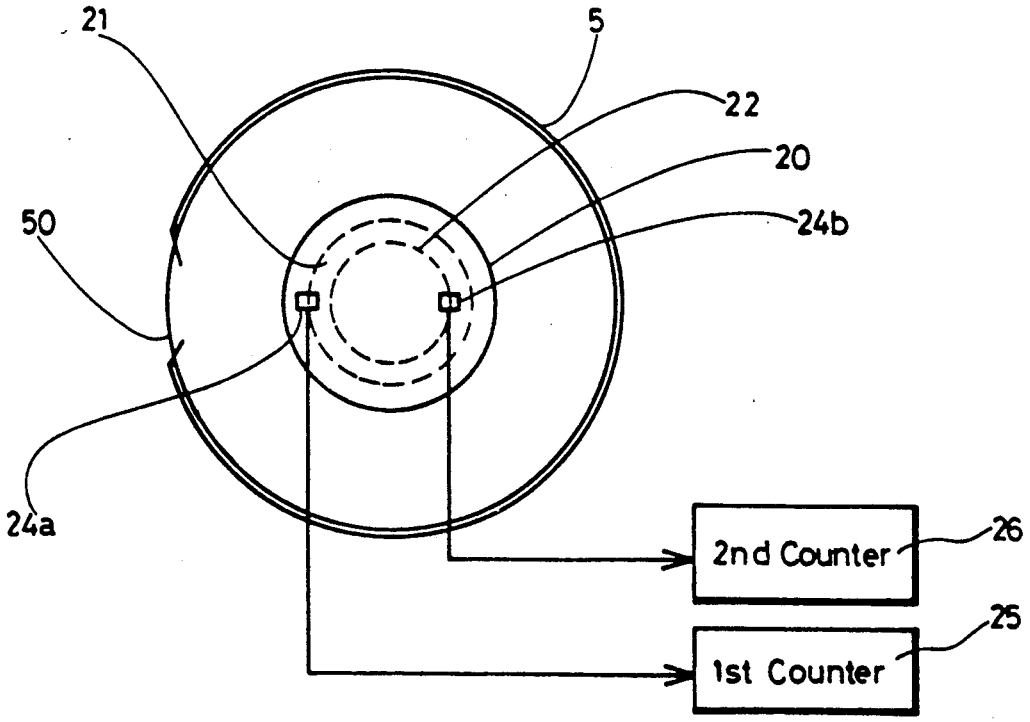
FIG. 6 is a side view of a photoreceptor used for the second preferred embodiment of the present invention.

FIG. 5 is block diagram of a circuit of the copying machine according to this second preferred embodiment of the present invention. FIG. 6 is a side view of the photoreceptor 5 used for the second preferred embodiment.

With reference to FIG. 6, the photoreceptor 5 is formed around a drum 50. A photoreceptor timing disc or PT disc 20 is fixed to a rotational shaft of the drum 50 for detecting the rotational position of the photoreceptor 5. Normally, the photoreceptor 5 receives the latent image starting with its starting edge a. The length between the starting edge a and the ending edge b is selected to be somewhat longer than the possible maximum copy size, for example, A3. The PT disc 20 comprises a plurality of slits 21 and 22 at its outer peripheral and inner peripheral, respectively. A pair of slit detection members **24*a* and 24*b* are faced to each of the slits for detecting the positions of the slits 21 and 22. The detection signals of the slit detection members 24*a* and 24*b* are inputted into a first an second counters 25 and 26, respectively, to count them. On the PT disc 20, a predetermined number of, for example, "50" slits 21 and 22 are formed. In accordance with the slit counting of the first counter 25 and the second counter 26, the rotational position (angle) of the photoreceptor 5 can be detected. For example, a position corresponding to the starting edge of the photoreceptor 5 is selected to be "0", and the counting of "50" is selected to mean the single and full rotation of the photoreceptor 5, whereby the counted value is reset. The first counter 25 is operated when the latent image is formed starting with the starting edge a, in which "0", for example, means that the starting edge a reaches in front of the charger 6 as shown in FIG. 2. The second counter 26 is operated when the latent image is formed starting with the center c of the photoreceptor 5, in which "0", for example, means that the center c reaches in front of the charger 6 in place of the starting edge a as shown in FIG. 2**.

According to the counted values starting with this position, the copying operation is executed.

With reference to FIG. 5, the counted value of each of the counters 25 and 26 is inputted into the control circuit 30 to cause the copying operation. As mentioned above, the control circuit 30 is responsive to the outputs of the detection means 23 for providing the control signal 10 to the controlled means 22. The detection means 23 comprises four micro-switches MS1-MS4. The fourth switch MS4 is provided for detecting the presence of a copy paper at a manual paper insertion section 40. The first switch MS1 is provided for detecting the presence of the copy paper prior to the paper feeding rollers 29. The second switch MS2 is provided for detecting the presence of the copy paper separated by the separation rollers 41. The third switch MS3 is provided for detecting the presence of the copy paper expelled by the exhaust rollers 17. Although not shown in the drawings, it may be evident that some additional micro-switches are provided for detecting the light exposure starting position of the document table 4 detecting the overrun of the document table 4.

By operating the copy switch 31, the control circuit 30 provides the signal to the controlled means 22 to rotate the motor 19. The rotation of the motor 19 enables the rotation of the photoreceptor 5 via the transmission, accordingly. In synchronization with the rotation of the photoreceptor 5, the control circuit 30 receives the signals representative of the rotation of the photoreceptor 5 from the counters 25 and 26. Responsive to the detection signals of the detection means 23, the control circuit 30 provides the control signal I0 to the controlled means 22 to sequentially drive them.

If the copy size is A3 or B4 which is more than half of the possible maximum copy size, the control circuit 30 is responsive to the contents of the first counter 25 for executing the controls to form the latent image starting with the starting edge a of the photoreceptor 5. If the copy size is A4 or B5 which is less than one half of the maximum copy size, the circuit 30 is responsive to the contents of the second counter 26 for executing the formation of the latent image starting with either the center c or the starting edge a of the photoreceptor 5. Either of the counters 25 and 26 which earlier reaches its contents of "50" representative of the position of the photoreceptor 5 is used. When the counter 26 reaches "50", it is meant that, at this timing, the center c of the photoreceptor 5 faces the charger 6, from which the formation of the image is started.

In addition to the above control, the control circuit 30 causes the timer 301 to be automatically started in response to the signal representative of the end of the copying operation. During the time as set by the timer 301 from the end of the copying operation, the pre-copy operation is continued as described below.

Figure 7:
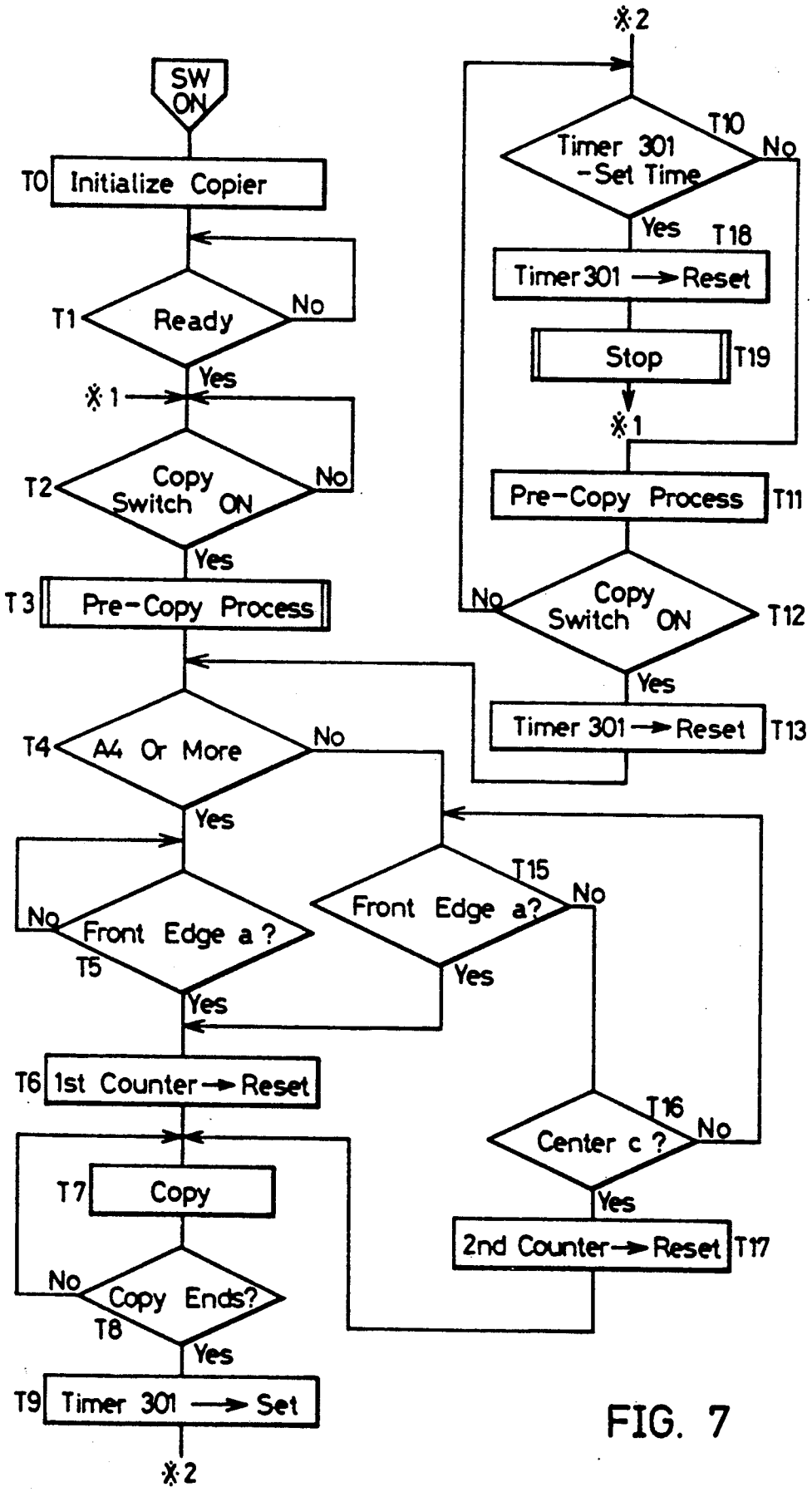
FIG. 7 is a flow chart of the operation of the copying machine according to the second preferred embodiment of the present invention.

FIG. 7 is a flow chart of the operation in this second preferred embodiment of the present invention.

Step T1: In response to the power supply, the control circuit 30 initializes the copying machine. This step is executed to detect whether the copying machine is placed at the ready condition.

T2: Determines whether the copy switch 31 has been actuated and proceeds upon actuation thereof.

T3: Responsive to the actuation of the copy switch 31, this step is selected to conduct the pre-copy operation.

T4: It is detected whether the size of the document to be copied is A3(or B4) or A4 (or B5). To detect the copy size to be copied, the size of the document is detected or the copy paper selected is detected.

T5: When A3 size document is to be copied, this step is selected. Step T5 is executed to detect whether the starting edge a of the photoreceptor 5 is positioned at the image formation starting position, in order to start the image formation starting with the starting edge a of the photoreceptor 5. Normally, the drum 50 is continued to be rotated in order to conduct successively with the termination of the pre-copy operation. Then, it is detected whether the first counter 25 for counting the slit number of the slit 21 of the disc 20 counts the number "50". The counting of "50" by the first counter 25 indicates that the starting edge a of the photoreceptor 5 reaches in front of the charger 6. Responsive to the detection of this timing, step T6 is selected.

T6: The first counter 25 is reset. Then, the first counter 25 is caused to count the slit number according to the rotation of the drum 50, so that the rotational position of the photoreceptor 5 is inputted into the control circuit 30.

T7: In conformance with the position of the starting edge a, the control circuit 30 executes the copying operation. Since the starting edge a of the photoreceptor 5 is positioned in front of the charger 6, the charger 6 is operated and, simultaneously the copy paper is supplied. The copy paper is stopped at the feeding rollers 29 once. As soon as the starting edge a reaches the light exposure position, the copy lamp CL of the light emitting device 7 is illuminated to scan the document table 4 starting with the scanning starting position. The document image is formed on the photoreceptor 5 starting with on the starting edge a, subsequently. Starting with the starting edge a, the control circuit 30 conducts the copying operation by driving the controlled means 22.

T8: After the copying operation, this step is selected to detect whether the number of the copy papers selected have been copied.

T9: The timer 301 is reset.

T10 and T11: Without stopping the copy operation, the pre-copy operation is conducted in the same manner as in step T3.

T12: It is detected whether the copy switch 31 is actuated.

Steps T10-T11-T12-T10 are repeated. During the counting time of the timer 301, the copy switch 31 is operated so that steps T12 is advanced to T13, in which the timer 301 is reset. After the timer 301 is reset, step T4 is selected in which the copy operation is conducted.

Concerning the copying operation for A4 (or B5) size:

T4–T15: It is detected whether the starting edge a of the photoreceptor 5 is positioned at the image formation starting position.

T16: If it is not detected in step T15, step T16 is selected in which the center c of the photoreceptor 5 is positioned at the image formation starting position. If the center c is not positioned at this position, step T15 is re-selected in which the above operations are repeated. That is, it is detected whether either the starting edge a or the center c of the photoreceptor 5 reaches the image formation starting position or not.

T17: If it is detected in step T16 that the center c reaches the image formation position, step T17 is selected in which the second counter 26 is reset in the same manner as in step T5. For example, when the second counter 26 counts "50", it is meant that the center c is positioned in front of the charger 6 at the image formation starting position.

T17-T7: These steps are selected after the detection of the center c. Responsive to the contents of the second counter 26, the control circuit 30 controls the controlled means 22 with reference to the position of the center c, so that the image is formed starting with the center c.

Regarding the copy size which is less than half of the maximum copy size, when either the center c or the starting edge a of the photoreceptor 5 reaches the image formation starting position, the copying operation is started at this timing. It is unnecessary to await the full turn of the photoreceptor 5. The copying time can be shortened accordingly. The surface of the photoreceptor 5 is uniformly used since either the former portion or the latter portion of the photoreceptor 5 is selectively and alternatively used.

When the timer 301 is set and the copy switch 31 is not operated during this time, step T10 is advanced to step T19 in which the copying operation is stopped. Before step T19 is selected, step T18 is selected in which the timer 301 is reset. After the stop, step T2 is selected in which the actuation of the copy switch 31 is awaited.

Thus, to make each of a plurality of copied papers, the copy switch 31 is operated to make a single copy, so that steps T8-T9-T10-T11 are selected. In step T11, the pre-copy operation is executed. By repeating step T12-T10-T11-T12, the actuation of the copy switch 31 is awaited during the time as set by the timer 301. After the next document is placed and the copy switch 31 is operated, the above operations are repeated.

As described above, in accordance with the present invention, upon the termination of the previous copying operation, the timer is automatically actuated to start the pre-copy process for the following copying operation. It is detected whether, during the time as set for the timer, a copy start instruction to start the following copying operation is inputted. Therefore, any loss time of conducting the pre-copy process can be neglected in the following copying operation. When the new document to be copied replaces the old one, the new document can be copied without any loss time of conducting the pre-copy process for this copying operation.

While only certain embodiments of the present invention have been described, it will be apparent to those skilled in the art that various changes and modifications may be made therein without departing from the spirit and scope of the present invention as claimed.

What is claimed is:

1. An electrophotographic copying machine comprising:

initialization means for initializing a photoreceptor receiving a latent image thereon;

copying means, responsive to the operation of the initialization means, for copying a document; and timer means, responsive to a first completion of said copying means, for counting a time immediately after said first completion when a pre-copy operation is conducted;

said initialization means, being operable during the time counted by said timer means, for initializing the photoreceptor to perform a pre-copy process for a subsequent copy step just following the copying operation of the first document to thereby facilitate immediate copying of a second document.

2. The machine of claim 1, further comprising display means, responsive to the operation of said initialization means, for indicating that the copying operation is possible.

3. The machine of claim 2, wherein said initialization means is responsive to the initial positioning of a document scanning or the switching off of a copy lamp emitting light beams toward the document.

4. The machine of claim 2, further comprising a copy start switch means operable to start to copy the second document, the copy start switch means being operable during the full time counted by said timer means.

5. The machine of claim 1, further comprising:

detection means for detecting the starting edge or the center of the photoreceptor as compared with the possible maximum copy size;

size detection means for detecting whether the copy size is less than half of the possible maximum copy size;

image forming means, responsive to the detection of the copy size detection means, for forming the image starting with either the starting edge or the center of the photoreceptor.

6. The machine of claim 5, wherein the photoreceptor is provided on a drum having a disc including a plurality of slits, and said detection means comprises slit position detection means.

7. The machine of claim 1 wherein said initialization means performs a pre-copy process including operation of a developing station.

8. The machine of claim 7 wherein said pre-copy process includes operation of all elements positioned around the photoreceptor except operation of a transference charger.

9. The machine of claim 8 wherein said pre-copy process also includes operation of the transference charger.

10. An electrophotographic copying machine comprising:

input means for receiving a command to copy a document and for developing a copy signal in response thereto;

copying means, responsive to said copy signal developed by said input means, for copying said document, said copying means including a photoreceptor and producing a copy end signal when copying of said document is completed;

timer means, responsive to development of said copy end signal by said copying means, for measuring a predefined time period;

initialization means, responsive to said timer, for performing a pre-copy process by initializing said photoreceptor for a subsequent copy step to facilitate the copying of a new said document immediately after copying of said document by said copying means, said initializing means being enabled during said predefined time period.

11. The copying machine of claim 10 wherein said initialization means enables said copying means for copying but does not provide a copy paper in proximity to said photoreceptor.

12. The copying machine of claim 10 further comprising means for determining whether a pre-copy process has been performed by said initialization means and enabling said copying means only upon completion thereof.

13. The copying machine of claim 10 further comprising display means, responsive to the operation of said initialization means, for indicating that said photoreceptor has been initialized and said copying means is ready for copying.

14. The copying machine of claim 13 wherein said copying means comprises:

document scanner means for scanning the document to be copied; and a copy lamp for illumination of the document to be copied;

said display means being operable in response to the return of said document scan means to an initial position.

15. The copying machine of claim 13 wherein said copying means comprises:

document scanner means for scanning the document to be copied; and a copy lamp for illumination of the document to be copied;

said display means being operable in response to the switching off of said copy lamp.

16. The machine of claim 13, further comprising:

detection means for detecting the starting edge or the center of the photoreceptor as compared with the possible maximum copy size;

size detection means for detecting whether the copy size is less than half of the possible maximum copy size;

image forming means responsive to the detection of the copy size detection means for forming the image starting with either the starting edge or the center of the photoreceptor.

17. The machine of claim 16, wherein the photoreceptor is provided with a plurality of slits and said detection means comprises slit position detection means.

18. The machine of claim 10 wherein said initialization means performs a pre-copy process including operation of a developing station.

19. The machine of claim 18 wherein said pre-copy process includes operation of all elements positioned around the photoreceptor except operation of a transference charger.

20. The machine of claim 19 wherein said pre-copy process also includes operation of the transference charger.

21. An electrophotographic machine comprising:

input means for monitoring whether a copy command has been received and for receiving said command to copy a document and for developing a copy signal in response thereto;

copying means, responsive to said copy signal developed by said input means, for copying said document, said copying means including a photoreceptor and producing a copy end signal when copying of said document is completed;

timer means, responsive to development of said copy end signal by said copying means, for measuring a time period;

initialization means, responsive to said timer, for performing a pre-copy process by automatically initializing said photoreceptor for a subsequent copy step to facilitate the copying of a new said document immediately after copying of said document by said copying means, said initialization means being enabled during said time period, said initialization means completing the initializing operation prior to the monitoring of any command by said input means.

22. The copying machine of claim 21 further comprising display means, responsive to the operation of said initialization means, for indicating that said photoreceptor has been initialized and said copying means is ready for copying the new said document.

23. The machine of claim 22, further comprising:

detection means for detecting the starting edge or the center of the photoreceptor as compared with the possible maximum copy size;

size detection means for detecting whether the copy size is less than half of the possible maximum copy size;

image forming means responsive to the detection of the copy size detection means for forming the image starting with either the starting edge or the center of the photoreceptor.

24. The machine of claim 23, wherein the photoreceptor is provided with a plurality of slits and said detection means comprises slit position detection means.

25. The machine of claim 21 wherein said initialization means performs a pre-copy process including operation of a developing station.

26. The machine of claim 25 wherein said pre-copy process includes operation of all elements positioned around the photoreceptor except operation of a transference charger.

27. The machine of claim 26 wherein said pre-copy process also includes operation of the transference charger.

28. A method of making photocopies in an electrophotographic copying machine having a copy start switch comprising the steps of:

copying a document to be copied with a copying means including a photoreceptor;

measuring a time period immediately after the completion of said copying step;

performing a pre-copy process by subsequently and automatically initializing said photoreceptor for a subsequent copy step during said time period after copying of said document is completed to facilitate the photocopying of a subsequent document;

said step of automatically initializing being performed without monitoring said copy start switch.

29. The method of claim 28 further comprising repeating said step of performing a pre-copy process with said subsequent document and then repeating said step of initializing.

30. The method of claim 28 wherein said step of performing a pre-copy process includes operation of a developing station.

31. The method of claim 30 wherein said pre-copy process includes operating of all elements positioned around the photoreceptor except operation of a transference charger.

32. The method of claim 31 wherein said pre-copy process also includes operating the transference charger.

* * * * *

UNITED STATES PATENT AND TRADEMARK OFFICE

CERTIFICATE OF CORRECTION

PATENT NO. : 5,130,749

DATED : July 14, 1992

INVENTOR(S) : Toyoki Tanaka

It is certified that error appears in the above-identified patent and that said Letters Patent is hereby corrected as shown below:

On title page, item [19], "Tanada" should read --Tanaka--.

Item [75], change "Tanada" to read --Tanaka--.

Title page, add item [73] Assignee: to read --Sharp Kabushiki Kaisha, Osaka, Japan--.

Signed and Sealed this

Fourteenth Day of September, 1993

Bruce Lehman

*Attest:*

BRUCE LEHMAN

*Attesting Officer*

*Commissioner of Patents and Trademarks*